US009266155B2

(12) United States Patent
Ma et al.

(10) Patent No.: US 9,266,155 B2
(45) Date of Patent: Feb. 23, 2016

(54) SUPER LARGE DIAMETER LONGITUDINAL WELDED PIPE FORMING MACHINE SET

(75) Inventors: Li Ma, Dalian (CN); Guohong Gao, Dalian (CN); Zhaokui Lang, Dalian (CN)

(73) Assignee: DALIAN SAGE GROUP CO., LTD., Dalian, Liaoning (CN)

( * ) Notice: Subject to any disclaimer, the term of this patent is extended or adjusted under 35 U.S.C. 154(b) by 385 days.

(21) Appl. No.: 13/989,098

(22) PCT Filed: Mar. 22, 2011

(86) PCT No.: PCT/CN2011/072048

§ 371 (c)(1),
(2), (4) Date: May 23, 2013

(87) PCT Pub. No.: WO2012/068809

PCT Pub. Date: May 31, 2012

(65) Prior Publication Data

US 2013/0239638 A1 Sep. 19, 2013

(30) Foreign Application Priority Data

Nov. 23, 2010 (CN) ..... 2010 1 0555624
Nov. 23, 2010 (CN) ..... 2010 2 0620204 U

(51) Int. Cl.
*B21B 19/02* (2006.01)
*B21C 37/08* (2006.01)

(52) U.S. Cl.
CPC ..... *B21B 19/02* (2013.01); *B21C 37/08* (2013.01)

(58) Field of Classification Search
CPC ..... B21D 5/12; B21D 5/08; B21C 37/02; B21C 37/08; B21B 19/02
See application file for complete search history.

(56) References Cited

U.S. PATENT DOCUMENTS

| | | | | | |
|---|---|---|---|---|---|
| 1,906,987 | A | * | 5/1933 | McDougall | 219/160 |
| 4,299,108 | A | * | 11/1981 | Kato et al. | 72/178 |
| 4,651,914 | A | * | 3/1987 | Sprung et al. | 219/130.21 |
| 4,697,446 | A | * | 10/1987 | Yamamoto et al. | 72/178 |
| 4,770,019 | A | * | 9/1988 | Kuramoto et al. | 72/181 |
| 5,016,459 | A | * | 5/1991 | Kuramoto | 72/178 |
| 5,301,869 | A | * | 4/1994 | Toyooka et al. | 72/368 |
| 5,784,911 | A | * | 7/1998 | Hashimoto et al. | 72/52 |

* cited by examiner

*Primary Examiner* — Teresa M Ekiert
(74) *Attorney, Agent, or Firm* — Novick, Kim & Lee, PLLC; Allen Xue

(57) ABSTRACT

A super large diameter longitudinal welded pipe forming machine set comprises an edge hollow-bending device (1), a cage roll forming machine (2) and a plate-frame type forming machine (3), wherein the edge hollow-bending device (1) includes a machine seat (1.1), a pinch centring device (1.2) and a plurality of edge bending mechanisms (1.3); the cage roll forming machine (2) is an open cage roll forming machine combined by an outer roll device (2.1) and an inner roll (2.4); each equal rigid frame of the plate-frame type forming machine (3) includes a machine frame body (3.2), an upper horizontal roll mechanism (3.4), an upper horizontal roll adjusting mechanism (3.5), a sliding seat (3.10), a supporting plate (3.11), a hydraulic cylinder (3.12), a lower horizontal roll mechanism (3.6), a lower horizontal roll adjusting mechanism (3.7), a side vertical roll mechanism (3.8) and a side vertical roll adjusting mechanism (3.9).

8 Claims, 5 Drawing Sheets

SUPER LARGE DIAMETER LONGITUDINAL WELDED PIPE FORMING MACHINE SET

TECHNICAL FIELD

The present invention relates to a steel pipe welding equipment, particularly relates to a super large diameter longitudinal welded pipe forming machine set for producing a welded steel pipe with a diameter of bigger than Φ630 mm.

BACKGROUND

At present, all industries have more requirements to conveying pipe products in machinery industry with the development of science and technology. For example, a large amount of big-diameter and high-performance conveying pipes, especially conveying pipes with a diameter of bigger than Φ630 mm are required in oil exploration. However, the steel pipe manufacturers both at home and aboard can only produce conveying pipes with a diameter of less than Φ630 mm, and a single method to produce the conveying pipes with a diameter of less than Φ630 mm has always been used. For example, some foreign manufacturers use FFX forming method, namely flexible forming method, and some other steel pipe manufacturers both at home and aboard normally use a cage roll type forming machine set. Therefore, it has become a difficult problem for the steel pipe manufacturers both at home and aboard to produce the conveying pipes with a diameter of bigger than Φ630 mm using each of the aforementioned single production methods. In a case where the cage roll forming machine set is used to produce the super large diameter longitudinal welded pipe, forming rolls are to be distributed on a forming surface of a work piece, and the problem thereof is that, even though the forming effect is good, one of outer rolls has to be heavier than 10 tons which makes it difficult to produce and install such a big equipment and leads to high investment. In order to solve the above problem, it is very necessary to develop a super large diameter longitudinal welded pipe forming machine set by which a welded steel pipe with a diameter of bigger than Φ630 mm can be produced.

SUMMARY OF THE INVENTION

In order to avoid the disadvantages and deficiencies in the above technique, the present invention provides a super large diameter longitudinal welded pipe forming machine set, which is characterized with reasonable arrangement and compact structure design and can be used to produce a super large diameter longitudinal welded pipe without using an extra heavy equipment. Furthermore, it also has advantages of high production efficiency, high forming quality, low investment cost, safe operation and convenient use.

The present invention is realized as follows:

The super large diameter longitudinal welded pipe forming machine set, wherein a longitudinal welded pipe forming machine set sequentially comprising an edge hollow-bending device, a cage roll forming machine and a plate-frame type forming machine is disposed according to a forming process of the super large diameter longitudinal welded pipe, wherein the edge hollow-bending device includes a machine seat, a pinch centring device and a plurality of edge bending mechanisms; the electric pinch centring device is disposed on the machine seat, and the plurality of edge bending mechanisms are distributed after the pinch centring device so as to correspond to different cross sections of a strip-shaped work piece in an edge bending process; the work piece, after the edge bending forming by the edge hollow-bending device, is delivered into an open cage roll forming machine combined by an outer roll device and an inner roll; a plate-frame type forming machine is disposed after the cage roll forming machine combined by the outer roll device and the inner roll; wherein the plate-frame type forming machine is provided with three or more plate type rigid frames and transmission devices for driving rolls on a base; each of the plate type rigid frame includes a machine frame body, an upper horizontal roll mechanism, an upper horizontal roll adjusting mechanism, a sliding seat, a supporting plate, a hydraulic cylinder, a lower horizontal roll mechanism, a lower horizontal roll adjusting mechanism, a side vertical roll mechanism and a side vertical roll adjusting mechanism; the machine frame body is an integrated structure formed by two plate bodies that are connected together; the upper horizontal roll mechanism including a roll shaft, a bearing seat and a horizontal roll is disposed in an upper sliding rail of the machine frame body corresponding to a top portion of the work piece; the upper horizontal roll adjusting mechanisms driven by an electric double worm shaft are disposed at both sides of a top portion centerline of the upper horizontal roll mechanism; the lower horizontal roll adjusting mechanism that is driven by an electric double worm shaft and includes a roll shaft, a bearing seat and a horizontal roll is disposed in a lower sliding rail of the machine frame body corresponding to the upper horizontal roll mechanism; top ends of two screws in the lower horizontal roll adjusting mechanism are connected to the supporting plate, and a top surface of the supporting plate is provided with the sliding seat; a rear end of the supporting plate is provided with the hydraulic cylinder for driving the sliding seat to slide in the supporting plate; the lower horizontal roll mechanism symmetric to the upper horizontal roll mechanism is disposed on a top surface of the sliding seat; two side vertical roll mechanisms are disposed symmetrically on the machine frame body corresponding to both sides of the work piece; and the side vertical roll mechanisms at both sides are symmetrically provided with the side vertical roll adjusting mechanisms driven by electric double worm shafts.

As is well-known, the normal steel pipe forming process includes gradually forming an I-shaped cross section of a work piece into a U-shaped cross section by a forming machine, and finally forming the open U-shaped cross section into a closed O-shaped cross section. Therefore, by analyzing the characteristics of the steel pipe forming process, the present invention provides a technical solution of a longitudinal welded pipe forming machine set sequentially comprising an edge hollow-bending device, a cage roll forming machine and a plate-frame type forming machine. Due thereto, the forming machines in accordance with the steel pipe forming characteristics have been reasonably used in different forming stages. During the forming stage of forming the I-shaped cross section of the work piece into the U-shaped cross section, the edge hollow-bending device including a machine seat, a pinch centring device and a plurality of edge bending mechanisms is adopted; during the U-shaped cross section forming stage, the open cage roll forming machine combined by an outer roll device and an inner roll, which includes the outer roll device, the inner roll, a pressing roll device, a lower driving roll, a cross beam, a supporting frame, a base and a lower support roll, is adopted; and during the closed O-shaped cross section forming stage, the plate-frame type forming machine including three or more plate type rigid frames is adopted, wherein each of the plate type rigid frame includes a machine frame body, an upper horizontal roll mechanism, an upper horizontal roll adjusting mechanism, a sliding seat, a supporting plate, a hydraulic cylinder, a lower horizontal roll mechanism, a lower horizontal roll adjusting mechanism, a side vertical roll mechanism and a side vertical roll adjusting mechanism. Accordingly, a good forming effect with respect to the welded pipe during the forming process is realized, thereby meeting the market requirement to the production of a welded steel pipe with a diameter of bigger than Φ630 mm. Therefore, the present invention is named as "A super large diameter longitudinal welded pipe forming machine set".

Compared with the prior art, the present invention has not only reasonable working process and machine set arrangement, but also compact structure design. The present invention can be used to produce super large diameter longitudinal welded pipe without using extra heavy equipments and has advantages of high production efficiency, high forming quality, low investment cost, safe operation, convenient use and the like.

1. Edge hollow-bending device:

1.1 machine seat; 1.2 pinch centring device; 1.3 edge bending mechanism; 1.4 upper and lower pinch rolls; 1.5 centring motor; 1.6 worm wheel adjusting screw; 1.7 bearing seat; 1.8 front and rear adjustable vertical rolls; 1.9 pinch roll adjusting screw; 1.10 edge bending motor; 1.11 upper roll; 1.12 lower roll; 1.13 left and right machine frames; 1.14 upper sliding seat; 1.15 lower sliding seat; 1.16 worm gear screw lifter; 1.17 middle roll; 1.18 work piece; 1.19 edge bending reduction gearbox; 1.20 transmission shaft; 1.21 upper main shaft; 1.22 lower main shaft; 1.23 upper horizontal sliding block; 1.24 lower horizontal sliding block.

2. Open cage roll forming machine:

2.1 outer roll device; 2.2 pressing roll device; 2.3 lower driving roll; 2.4 inner roll; 2.5 cross beam; 2.6 supporting frame; 2.7 base; 2.8 lower support roll; 2.9 inclined supporting stand; 2.10 adjusting screw; 2.11 nut; 2.12 cage roll cross beam; 2.13 small roll.

3. Plate-frame type forming machine:

3.1 base; 3.2 machine frame body; 3.3 transmission device; 3.4 upper horizontal roll mechanism; 3.5 upper horizontal roll adjusting mechanism; 3.6 lower horizontal roll mechanism; 3.7 lower horizontal roll adjusting mechanism; 3.8 side vertical roll mechanism; 3.9 side vertical roll adjusting mechanism; 3.10 sliding seat; 3.11 supporting plate; 3.12 hydraulic cylinder; 3.13 roll shaft; 3.14 bearing seat; 3.15 horizontal roll; 3.16 gear motor; 3.17 double worm shaft; 3.18 worm wheel; 3.19 encoder; 3.20 lead screw; 3.21 fixing plate; 3.22 coupling; 3.23 vertical roll shaft; 3.24 vertical roll seat; 3.25 side vertical roll.

DETAILED DESCRIPTION OF THE PREFERRED EMBODIMENTS

Figure 1:
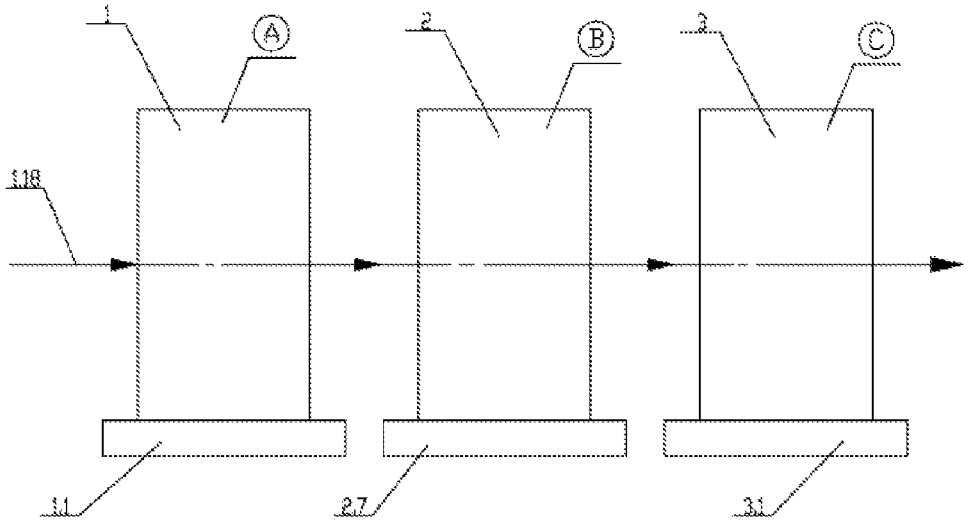
FIG. 1 is a schematic diagram of a main-viewed structural position in an embodiment of the present invention.
Figure 2:
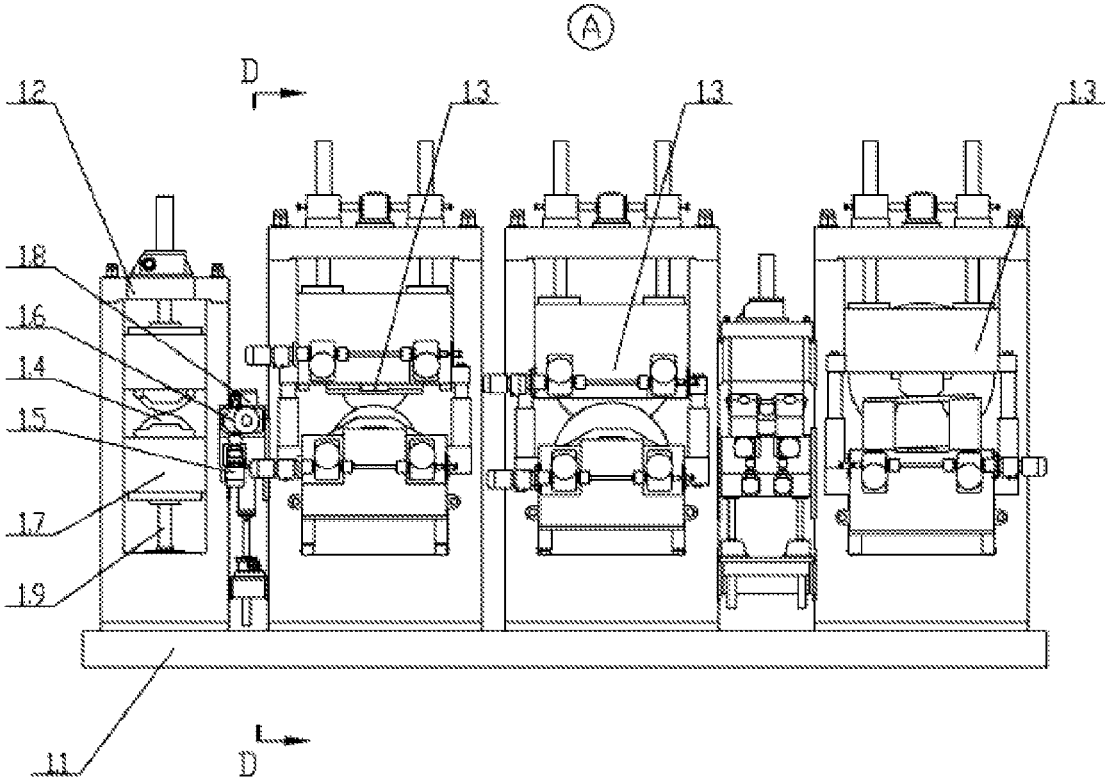
FIG. 2 is an enlarged schematic diagram of part A in FIG. 1.

FIGS. 1-7 show the embodiments of the present invention which is a super large diameter longitudinal welded pipe forming machine set for producing a welded steel pipe with a diameter of bigger than Φ711 mm. As shown in FIG. 1, the longitudinal welded pipe forming machine set sequentially comprises an edge hollow-bending device 1, a cage roll forming machine 2 and a plate-frame type forming machine 3 according to the forming process of the super large diameter longitudinal welded pipe; the edge hollow-bending device, as shown in FIG. 2, includes a machine seat 1.1, a pinch centring device 1.2 and a plurality of edge bending mechanisms 1.3; the electric pinch centring device 1.2 is disposed on the machine seat 1.1, and the plurality of edge bending mechanisms 1.3 are distributed after the pinch centring device 1.2 so as to correspond to different cross sections of a strip-shaped work piece 1.18 in an edge bending process; the work piece 1.18, after the edge bending forming by the edge hollow-bending device 1, is delivered into an open cage roll forming machine 2 combined by an outer roll device 2.1 and an inner roll 2.4; a plate-frame type forming machine 3 is disposed after the cage roll forming machine 2 combined by the outer roll device 2.1 and the inner roll 2.4; wherein the plate-frame type forming machine 3 is provided with three or more plate type rigid frames and transmission devices for driving rolls on a base 3.1; each of the plate type rigid frame includes a machine frame body 3.2, an upper horizontal roll mechanism 3.4, an upper horizontal roll adjusting mechanism 3.5, a sliding seat 3.10, a supporting plate 3.11, a hydraulic cylinder 3.12, a lower horizontal roll mechanism 3.6, a lower horizontal roll adjusting mechanism 3.7, a side vertical roll mechanism 3.8 and a side vertical roll adjusting mechanism 3.9; the machine frame body 3.2 is an integrated structure formed by two plate bodies that are connected together; the upper horizontal roll mechanism 3.4 including a roll shaft 3.13, a bearing seat 3.14 and a horizontal roll 3.15 is disposed in an upper sliding rail of the machine frame 3.2 corresponding to a top portion of the work piece 1.18; the upper horizontal roll adjusting mechanisms 3.5 driven by electric double worm shafts are disposed at both sides of a top portion centerline of the upper horizontal roll mechanism 3.4; the lower horizontal roll adjusting mechanism 3.7 that is driven by an electric double worm shaft and includes a roll shaft 3.13, a bearing seat 3.14 and a horizontal roll 3.15 is disposed in a lower sliding rail of the machine frame body 3.2 corresponding to the upper horizontal roll mechanism 3.4; top ends of two lead screws 3.20 in the lower horizontal roll adjusting mechanism 3.7 are connected to the supporting plate 3.11, and a top surface of the supporting plate 3.11 is provided with the sliding seat 3.10; a rear end of the supporting plate 3.11 is provided with the hydraulic cylinder 3.12 for driving the sliding seat 3.10 to slide in the supporting plate 3.11; the lower horizontal roll mechanism 3.6 symmetric to the upper horizontal roll mechanism 3.4 is disposed on a top surface of the sliding seat 3.10; two side vertical roll mechanisms 3.8 are symmetrically disposed on the machine frame body 3.2 corresponding to both sides of the work piece 1.18; and the side vertical roll mechanisms 3.8 at both sides are symmetrically provided with the side vertical roll adjusting mechanisms 3.9 driven by electric double worm shafts.

The electric pinch centring device 1.2 comprises a centring motor 1.5, left and right supporting frames, a bearing seat 1.7, a worm wheel adjusting screw 1.6, upper and lower pinch rolls 1.4, front and rear adjustable vertical rolls 1.8 and pinch roll adjusting screw 1.9; the left and right supporting frames are symmetrically disposed on the machine seat 1.1, and the two supporting frames respectively support the opposite upper and lower pinch rolls 1.4 that are mounted on upper and lower pinch roll shafts through the bearing seat 1.7; the upper and lower pinch rolls 1.4 are respectively provided with the pinch roll adjusting screw 1.9; vertical roll shafts in parallel with each other are symmetrically disposed on front and rear machine frames at two sides of a rolling line; and the front and rear adjustable vertical rolls 1.8, whose positions are adjusted by the worm wheel adjusting screw 1.6 driven by the centring motor 1.5, are respectively mounted on the vertical roll shafts.

Figure 3:
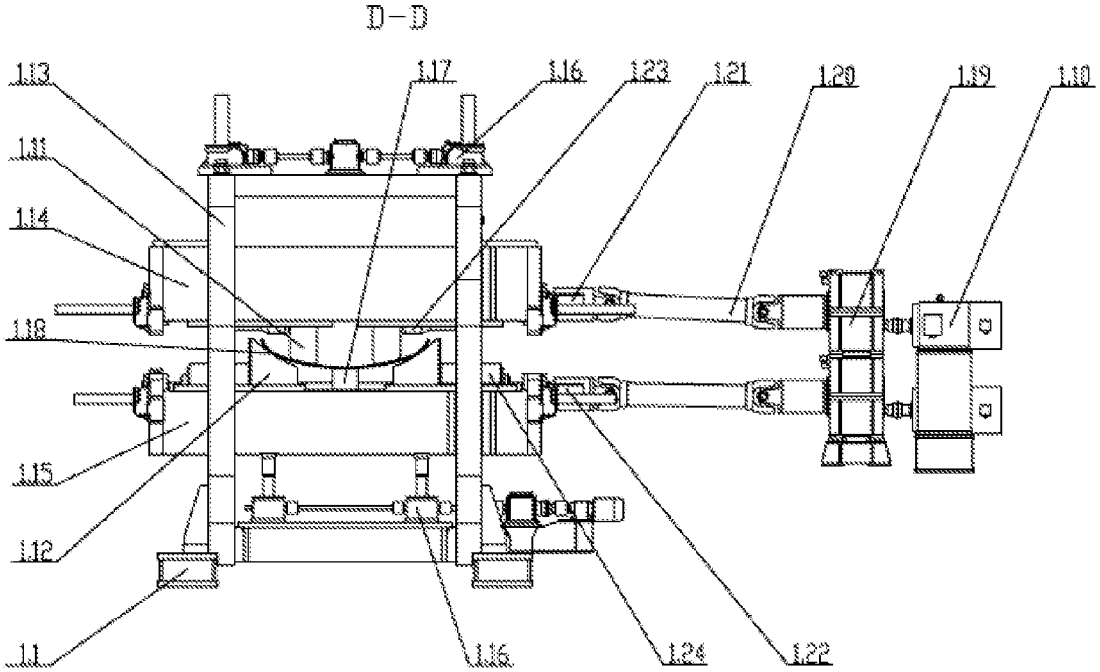
FIG. 3 is an enlarged section view along a D-D line in FIG. 2.

Each of the edge bending mechanisms 1.3, as shown in FIG. 3, comprises a machine seat 1.1, an edge bending motor 1.10, an edge bending reduction gearbox 1.19, a transmission shaft 1.20, an upper roll 1.11, an upper sliding seat 1.14, a lower sliding seat 1.15, a lower roll 1.12, left and right machine frames 1.13, a worm gear screw lifter 1.16, a middle roll 1.17, an upper main shaft 1.21, a lower main shaft 1.22, an upper horizontal sliding block 1.23 and a lower horizontal sliding block 1.24; the left and right machine frames 1.13 are symmetrically disposed on the machine seat 1.1, and upper and lower ends of each machine frame 1.13 are respectively provided with the worm gear screw lifter 1.16, and the left and right machine frames 1.13 are respectively provided with sliding grooves in which the upper sliding seat 1.14 and the lower sliding seat 1.15 that are connected with the worm gear screw lifter 1.16 are respectively mounted; the upper horizontal sliding block 1.23, whose horizontal distance is adjustable, is disposed in the upper sliding seat 1.14, and the upper roll 1.11 is mounted on the upper horizontal sliding block 1.23; the lower horizontal sliding block 1.24, whose horizontal distance is adjustable, is disposed in the lower sliding seat 1.15, and the lower roll 1.12 is mounted on the lower horizontal sliding block 1.24; the machine seat 1.1 is connected with the middle roll 1.17 such that the middle roll 1.17 is slidingly connected in the lower sliding seat 1.15 and in touch with a bottom surface of the strip-shaped work piece 1.18; the upper main shaft 1.21 and the lower main shaft 1.22 driven by the edge bending motor 1.10 and the edge bending reduction gearbox 1.19 are respectively disposed in the upper sliding seat 1.14 and the lower sliding seat 1.15; the upper roll 1.11 and the lower roll 1.12, that respectively include the upper horizontal sliding block 1.23, the lower horizontal sliding block 1.24 and a roll body, are respectively disposed on the upper main shaft 1.21 and the lower main shaft 1.22; and the middle roll 1.17 in touch with the strip-shaped work piece 1.18 is mounted on the lower main shaft 1.22.

Figure 4:
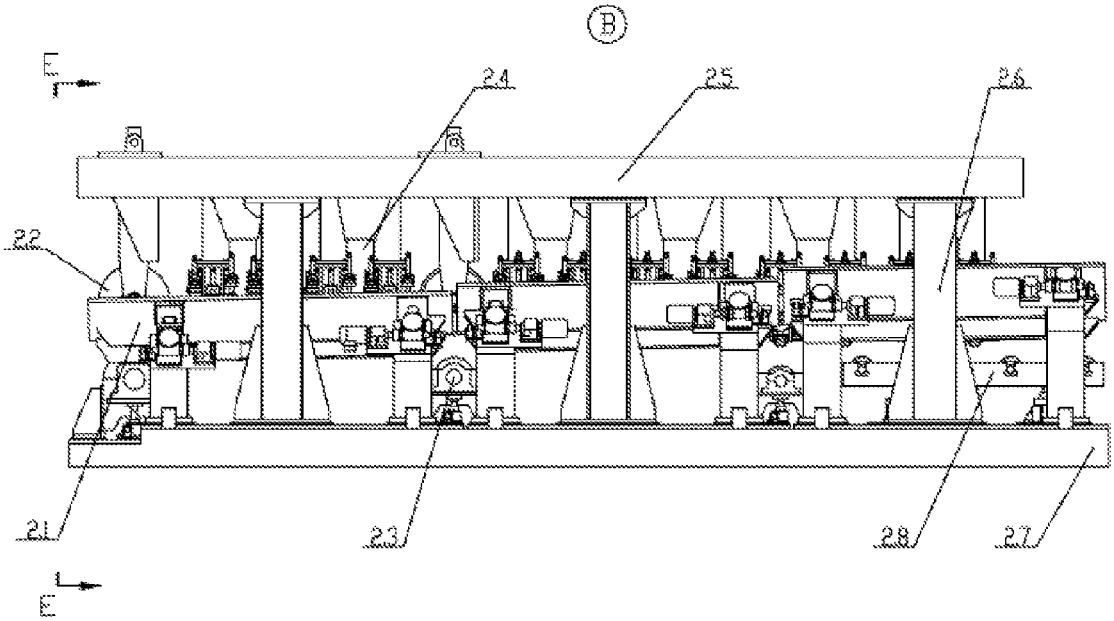
FIG. 4 is an enlarged schematic diagram of part B in FIG. 1.
Figure 5:
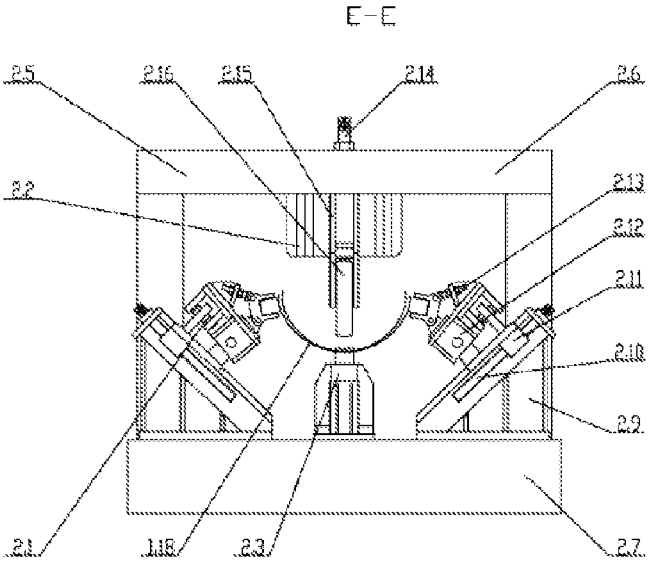
FIG. 5 is an enlarged section view along an E-E line in FIG. 4.
Figure 6:
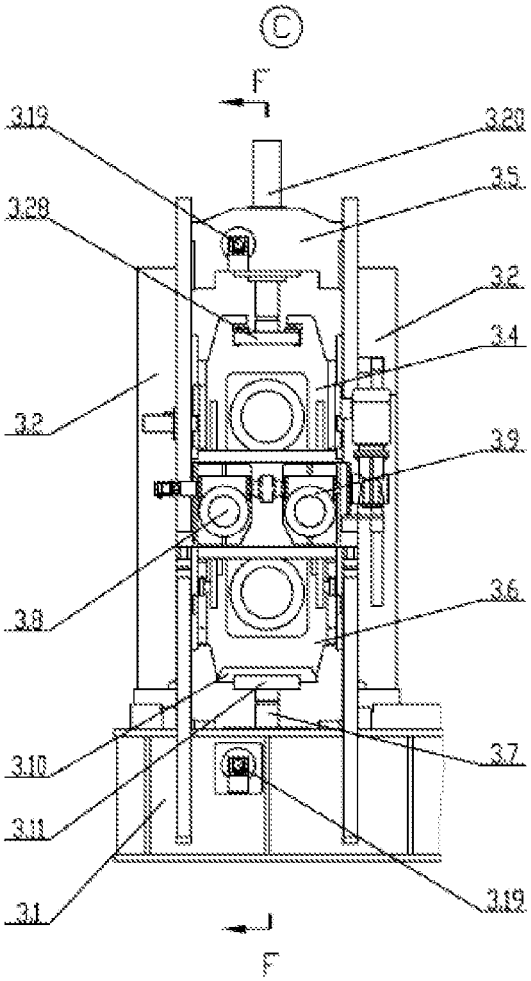
FIG. 6 is an enlarged schematic diagram of part C in FIG. 1.
Figure 7:
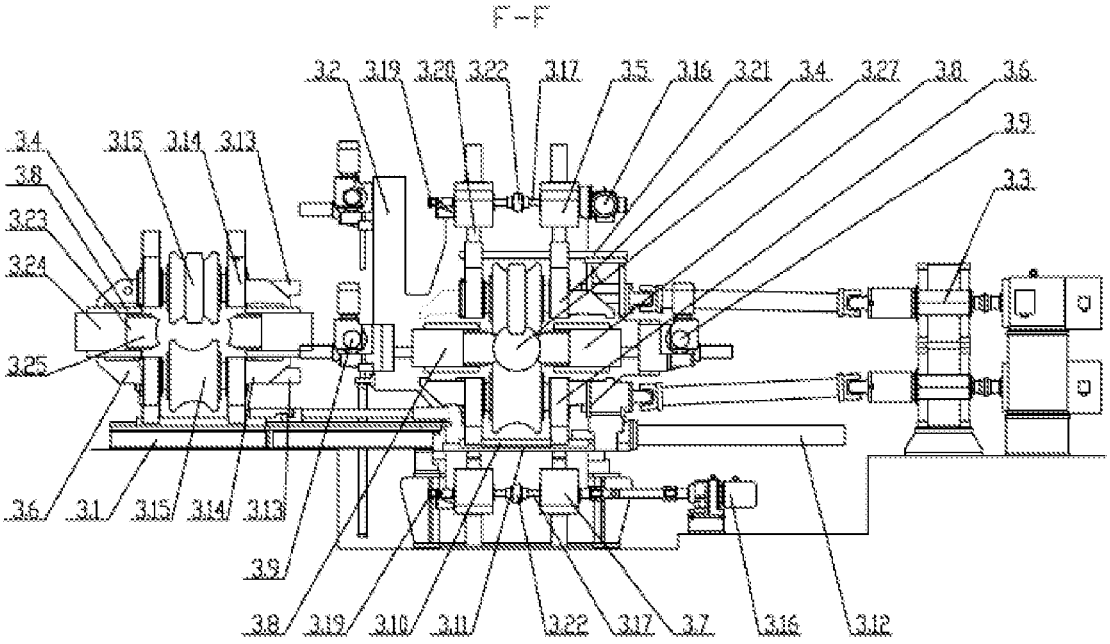
FIG. 7 is an enlarged section view along an F-F line in FIG. 6.

The open cage roll forming machine 2 combined by the outer roll device 2.1 and the inner roll 2.4, as shown in FIGS. 4 and 5, comprises the outer roll device 2.1, the inner roll 2.4, a pressing roll device 2.2, a lower driving roll 2.3, a cross beam 2.5, a supporting frame 2.6, a base 2.7 and a lower support roll 2.8; the cross beam 2.5 is connected with the base 2.7 through the supporting frame 2.6 to form a cage type frame; in the frame, the outer roll device 2.1, the lower driving roll 2.3 and the lower support roll 2.8 are respectively mounted on the base 2.7, and the pressing roll device 2.2 and the inner roll 2.4 are mounted on the cross beam 2.5; the outer roll device 2.1 supports two edges of the bent work piece 1.18 by a plurality of cage rolls from outside, and the outer roll device 2.1 includes plural sets of cage roll mechanisms distributed at two sides of a transverse vertical centerline of the frame, wherein each set of the cage roll mechanisms are symmetric to each other and are connected to the base through inclined supporting stands 2.9; the pressing roll device 2.2 including a screw 2.14, a roll frame 2.15 and a pressing roll 2.16 is mounted on a lower end at one side of the cross beam 2.5, thereby the pressing roll being caused to press towards an inner side of the work piece 1.18; the lower driving roll 2.3, which is driven by a motor and supports a bottom portion of the work piece 1.18, is mounted on a middle portion of the base 2.7; and the lower support roll 2.8 for supporting a bottom portion of a shaped steel pipe is mounted at a rear portion of the base 2.7, namely an outlet end of the forming machine set.

In the plural sets of the cage roll mechanisms constituting the outer roll device, each set is symmetrically divided into a left cage roll mechanism and a right cage roll mechanism which are connected to the base 2.7 through the inclined supporting stands 2.9; each of the cage roll mechanism includes the inclined supporting stand 2.9, an adjusting screw 2.10, a nut 2.11, a cage roll cross beam 2.12 and a small roll 2.13; the adjusting screw 2.10 with the nut 2.11 connected thereon is disposed in the inclined supporting stand 2.9, and the nut 2.11 is connected with the cage roll cross beam 2.12 on which a plurality of the small rolls 2.13 are hinged, such that the small rolls 2.13 in each set of the cage roll mechanism are tangent to a corresponding bent edge surface of the work piece 1.18.

Each of the upper horizontal roll adjusting mechanisms 3.5 and the lower horizontal roll mechanism 3.6 driven by the electric double worm shafts includes a gear motor 3.16, a double worm shaft 3.17, a worm wheel 3.18, an encoder 3.19, a lead screw 3.20 and a fixing plate 3.21.

The side vertical roll mechanism 3.8 at each side includes a vertical roll shaft 3.23, a vertical roll seat 3.24 and a side vertical roll 3.25; bearings are disposed at both an upper end and a lower end in a shaft hole of the side vertical roll 3.25, such that two extending ends of the vertical roll shaft 3.23 disposed in two bearing holes are respectively fixed on the vertical roll seat 3.24.

The side vertical roll adjusting mechanism 3.9 driven by the electric double worm shaft at each side includes a gear motor 3.16, a double worm shaft 3.17, a worm wheel 3.18, an encoder 3.19 and a lead screw 3.20; the gear motor 3.16 is disposed at either side of the machine frame body and is connected to one end of the double worm shaft 3.17, while the encoder 3.19 is connected to the other end of the double worm shaft 3.17.

The above descriptions are only preferred embodiments of the present invention, and the protecting scope of the present invention is not limited to it. All equivalent replacements or changes made on the basis of the technical solutions and conceptions of the present invention by practitioners skilled in the art will be included in the protecting scope of the present invention.

We claim:

1. A super large diameter longitudinal welded pipe forming machine set, comprising:

an edge hollow-bending device (1), an open cage roll forming machine (2), and a forming press (3) arranged successively in said order for forming a work piece (1.18) into a super large diameter longitudinal welded pipe, wherein the edge hollow-bending device comprises a machine seat (1.1), a pinch centering device (1.2) and a plurality of edge bending mechanisms (1.3), wherein the pinch centering device (1.2) is disposed on the machine seat (1.1), and the plurality of edge bending mechanisms (1.3) are disposed successively after the pinch centering device (1.2), and each edge bending mechanisms (1.3) bends the work piece (1.18) into a higher degree of curvature;

wherein the open cage roll forming machine (2) comprises an outer roll device (2.1) and an inner roll (2.4);

wherein the forming press (3) comprises three or more press units disposed on a base (3.1); each press unit comprises a machine frame body (3.2), an upper horizontal roll mechanism (3.4), an upper horizontal roll adjusting mechanism (3.5), a sliding seat (3.10), a supporting plate (3.11), a hydraulic cylinder (3.12), a lower horizontal roll mechanism (3.6), a lower horizontal roll adjusting mechanism (3.7), a side vertical roll mechanism (3.8) and a side vertical roll adjusting mechanism (3.9);

wherein the machine frame body (3.2) is an integrated structure formed by two plate bodies that are connected together;

wherein the upper horizontal roll mechanism (3.4) comprises a roll shaft (3.13), a bearing seat (3.14) and a horizontal roll (3.15) disposed on an upper sliding rail of the machine frame body (3.2) that receives a top portion of the work piece (1.18);

wherein the upper horizontal roll adjusting mechanism (3.5) is driven by electric double worm shafts and is disposed on both sides of a top portion centerline of the upper horizontal roll mechanism (3.4);

wherein the lower horizontal roll adjusting mechanism (3.7) is driven by an electric double worm shaft and comprises a roll shaft (3.13), a bearing seat (3.14) and a horizontal roll (3.15) disposed on a lower sliding rail of the machine frame body (3.2) the lower horizontal roll adjusting mechanism (3.7) is affixed to the supporting plate (3.11), and the sliding seat (3.10) is slidably disposed on the supporting plate (3.11), driven by the hydraulic cylinder (3.12) disposed on a rear part of the supporting plate (3.11); the lower horizontal roll mechanism (3.6) symmetric to the upper horizontal roll mechanism (3.4) is disposed on a top surface of the sliding seat (3.10); two side vertical roll mechanisms (3.8) are symmetrically disposed on the machine frame body (3.2) corresponding to both sides of the work piece (1.18); and the side vertical roll mechanisms (3.8) at both sides are symmetrically provided with the side vertical roll adjusting mechanisms (3.9).

2. The super large diameter longitudinal welded pipe forming machine set according to claim 1, wherein the electric pinch centering device (1.2) comprises a centering motor (1.5), left and right supporting frames, a bearing seat (1.7), a worm wheel adjusting screw (1.6), upper and lower pinch rolls (1.4), front and rear adjustable vertical rolls (1.8) and pinch roll adjusting screws (1.9);

wherein the left and right supporting frames are symmetrically disposed on the machine seat (1.1), and the two supporting frames respectively support the opposite upper and lower pinch rolls (1.4) that are mounted on upper and lower pinch roll shafts through the bearing seat (1.7); the upper and lower pinch rolls (1.4) are respectively provided with the pinch roll adjusting screws (1.9);

wherein vertical roll shafts are arranged in parallel with each other and are symmetrically disposed on front and rear machine frames at two sides of a rolling line; and wherein the front and rear adjustable vertical rolls (1.8), whose positions are adjusted by the worm wheel adjusting screw (1.6) driven by the centering motor (1.5), are respectively mounted on the vertical roll shafts.

3. The super large diameter longitudinal welded pipe forming machine set according to claim 1, wherein each of the edge bending mechanisms (1.3) comprises an edge bending motor (1.10), an edge bending reduction gearbox (1.19), a transmission shaft (1.20), an upper roll (1.11), an upper sliding seat (1.14), a lower sliding seat (1.15), a lower roll (1.12), left and right machine frames (1.13), a worm gear screw lifter (1.16), a middle roll (1.17), an upper main shaft (1.21), a lower main shaft (1.22), an upper horizontal sliding block (1.23) and a lower horizontal sliding block (1.24);

wherein the left and right machine frames (1.13) are symmetrically disposed on the machine seat (1.1), and upper and lower ends of each machine frame (1.13) are respectively provided with the worm gear screw lifter (1.16), and the left and right machine frames (1.13) are respectively provided with sliding grooves in which the upper sliding seat (1.14) and the lower sliding seat (1.15) that are connected with the worm gear screw lifter (1.16) are respectively mounted;

wherein the upper horizontal sliding block (1.23), whose horizontal distance is adjustable, is disposed on the upper sliding seat (1.14), and the upper roll (1.11) is mounted on the upper horizontal sliding block (1.23);

wherein the lower horizontal sliding block (1.24), whose horizontal distance is adjustable, is disposed on the lower sliding seat (1.15), and the lower roll (1.12) is mounted on the lower horizontal sliding block (1.24); and wherein the machine seat (1.1) is connected with the middle roll (1.17) such that the middle roll (1.17) is slidably connected to the lower sliding seat (1.15) and in touch with a bottom surface of the strip-shaped work piece (1.18); the upper main shaft (1.21) and the lower main shaft (1.22) driven by the edge bending motor (1.10) and the edge bending reduction gearbox (1.19) are respectively disposed on the upper sliding seat (1.14) and the lower sliding seat (1.15); the upper roll (1.11) and the lower roll (1.12), each comprising the upper horizontal sliding block (1.23), the lower horizontal sliding block (1.24) and a roll body, are respectively disposed on the upper main shaft (1.21) and the lower main shaft (1.22); and the middle roll (1.17) in touch with the bottom surface of the strip-shaped work piece (1.18) is mounted on the lower main shaft (1.22).

4. The super large diameter longitudinal welded pipe forming machine set according to claim 1, wherein the open cage roll forming machine (2) comprises the outer roll device (2.1), the inner roll (2.4), a pressing roll device (2.2), a lower driving roll (2.3), a cross beam (2.5), a supporting frame (2.6), a base (2.7) and a lower support roll (2.8);

wherein the cross beam (2.5) is connected with the base (2.7) through the supporting frame (2.6) to form a frame;

wherein, in the frame, the outer roll device (2.1), the lower driving roll (2.3) and the lower support roll (2.8) are respectively mounted on the base (2.7), and the pressing roll device (2.2) and the inner roll (2.4) are mounted on the cross beam (2.5); the outer roll device (2.1) contacts an outer side of the work piece (1.18) via a plurality of cage rolls, and the outer roll device (2.1) comprises plural sets of cage roll mechanisms distributed at two sides of a transverse vertical centerline of the frame, wherein each set of the cage roll mechanisms are symmetric to each other and are connected to the base (2.7) through a plurality of inclined supporting stands (2.9);

wherein the pressing roll device (2.2) comprises a screw (2.14), a roll frame (2.15) and a pressing roll (2.16), the pressing roll device (2.2) is mounted on the cross beam (2.5), so that the pressing roll (2.16) faces an inner side of the work piece (1.18); and wherein the lower driving roll (2.3) is mounted on a middle portion of the base (2.7); and the lower support roll (2.8)

for supporting a the work piece (1.18) is mounted at a rear portion of the base (2.7).

5. The super large diameter longitudinal welded pipe forming machine set according to claim 4, wherein, in the plural sets of the cage roll mechanisms in the outer roll device (2.1), each set of the cage roll mechanism is symmetrically divided into a left cage roll mechanism and a right cage roll mechanism, both connected to the base (2.7) through the plurality of inclined supporting stands (2.9);

wherein each of the cage roll mechanism comprises the inclined supporting stand (2.9), an adjusting screw (2.10), a nut (2.11), a cage roll cross beam (2.12) and small rolls (2.13); and wherein the adjusting screw (2.10) with the nut (2.11) connected thereon is disposed in the inclined supporting stand (2.9), and the nut (2.11) is connected with the cage roll cross beam (2.12) on which a plurality of the small rolls (2.13) are hinged so that the small rolls (2.13) in each set of the cage roll mechanism are tangent to a corresponding bent edge surface of the work piece (1.18).

6. The super large diameter longitudinal welded pipe forming machine set according to claim 1, wherein each of the upper horizontal roll adjusting mechanisms (3.5) and the lower horizontal roll mechanisms (3.6) driven by the electric double worm shafts comprises a gear motor (3.16), a double worm shaft (3.17), a worm wheel (3.18), an encoder (3.19), a lead screw (3.20) and a fixing plate (3.21).

7. The super large diameter longitudinal welded pipe forming machine set according to claim 1, wherein the side vertical roll mechanism (3.8) at each side comprises a vertical roll shaft (3.23), a vertical roll seat (3.24) and a side vertical roll (3.25); bearings are disposed at both an upper end and a lower end in a shaft hole of the side vertical roll (3.25) so that two extending ends of the vertical roll shaft (3.23) disposed in two bearing holes are respectively affixed to the vertical roll seat (3.24).

8. The super large diameter longitudinal welded pipe forming machine set according to claim 1, wherein the side vertical roll adjusting mechanism (3.9) driven by the electric double worm shaft at each side comprises a gear motor (3.16), a double worm shaft (3.17), a worm wheel (3.18), an encoder (3.19) and a lead screw (3.20); and wherein the gear motor (3.16) is disposed at either side of the machine frame body (3.2) and is connected to one end of the double worm shaft (3.17), while the encoder (3.19) is connected to the other end of the double worm shaft (3.17).

* * * * *